United States Patent [19]

Reba

[11] 4,322,027

[45] Mar. 30, 1982

[54] FILAMENT DRAW NOZZLE

[75] Inventor: Imants Reba, Vancouver, Wash.

[73] Assignee: Crown Zellerbach Corporation, San Francisco, Calif.

[21] Appl. No.: 192,973

[22] Filed: Oct. 2, 1980

[51] Int. Cl.[3] ..... B65H 51/16

[52] U.S. Cl. ..... 226/97

[58] Field of Search ..... 226/97, 7; 28/103, 247, 28/272, 271, 273, 274

[56] References Cited

U.S. PATENT DOCUMENTS

| | | | |
|---|---|---|---|
| 2,379,824 | 7/1945 | Mummery | 226/97 X |
| 3,341,394 | 9/1967 | Kinney | 28/103 X |
| 3,576,284 | 4/1971 | Fellous et al. | 226/97 |
| 3,655,862 | 4/1972 | Dorschner et al. | 226/97 X |
| 3,754,694 | 8/1973 | Reba | 28/272 X |
| 4,172,544 | 10/1979 | Pennings et al. | 226/97 |

*Primary Examiner*—Stanley N. Gilreath

*Attorney, Agent, or Firm*—Thomas R. Lampe

[57] ABSTRACT

A filament draw nozzle including throughbore defining means having a shoulder spaced from the throughbore, a housing defining an aperture and positioned on the throughbore defining means, said housing abutting the shoulder whereby the housing is aligned relative to the throughbore defining means, and fiber inlet defining means, said fiber inlet defining means including a fiber inlet feed tube slidably positioned in the housing aperture. The throughbore and the housing aperture are disposed in alignment whereby the fiber feed tube is concentrically disposed within said throughbore.

11 Claims, 5 Drawing Figures

FILAMENT DRAW NOZZLE

BACKGROUND OF THE INVENTION

1. Field of the Invention

This invention relates to air guns or filament draw nozzles used for the production of spun bonded nonwoven fabrics.

2. Description of the Prior Art

In the production of nonwoven webs from continuous filaments air guns or filament draw nozzles are commonly used to direct the filaments to the desired web forming location. Compressed air is generally supplied to the nozzles to serve as an entraining medium for the filaments. Examples of prior art filament draw nozzles are disclosed in Kinney U.S. Pat. No. 3,338,992, which issued Aug. 29, 1967; Kinney U.S. Pat. No. 3,341,394, which issued Sept. 12, 1967; Dorschner et. al. U.S. Pat. No. 3,655,862, which issued Apr. 11, 1972; Dorschner et al. U.S. Pat. No. 3,692,618, which issued Sept. 19, 1972; and Reba U.S. Pat. No. 3,754,694, which issued Aug. 28, 1973.

Prior art draw nozzles used for the production of nonwoven webs have a number of shortcomings, being generally characterized by their relatively complex design, often incorporating numerous parts, which results in high replacement cost and problems in maintaining the accurate alignment of parts. This latter problem can lead to asymmetric air flows which create swirl and thus roping of the filaments being conveyed by the nozzles. In addition, prior art nozzle constructions are often prone to plugging and wear problems and require high air pressure to operate. Thus, their operation is energy intensive and costly. Prior art draw nozzles also characteristically generally are difficult to thread initially and have relatively low fiber entrainment capacities due in large part to the fact that they commonly incorporate fiber feed tubes having relatively small internal diameters. Further, prior art draw nozzles, due to their complexity of construction, do not readily adapt themselves to internal vacuum monitoring, a desirable feature for filament flow control.

It is therefore an object of the present invention to provide a filament draw nozzle which eliminates, or at least minimizes, the aforesaid shortcomings of prior art arrangements.

BRIEF SUMMARY OF THE INVENTION

The filament draw nozzle of the present invention comprises three principal components that are self aligned when assembled. Assembly itself is quite simple since the three filament draw nozzle components are slip fit into position. The components are a throughbore defining means, a housing, and fiber inlet defining means which cooperate to draw filaments under tension and under controlled conditions through the nozzle. Several features of the nozzle contribute to attainment of the advantages set forth above. One significant feature is the use of a relatively large internal diameter cylindrical fiber feed tube which gives the nozzle a high fiber entrainment capacity. The interior of the fiber feed tube is in communication with a shallow bell mouth surface formed on the body member which cooperates with the fiber feed tube to minimize nozzle plugging and provide a high vacuum at the nozzle fiber inlet to facilitate initial fiber threading and provide a self-cleaning feature.

Cooperating structure on the three above identified components insures that skewness is avoided when the components are assembled. In addition, the nozzle readily lends itself to prompt and inexpensive parts replacement and internal vacuum monitoring for filament flow control purposes.

In the preferred embodiments of the invention continuously converging (and thus accelerating) flow passages are provided between an annular air cavity which receives pressurized air and the flow path for the filaments being drawn through the nozzle. This arrangement contributes to the ability of the nozzle to dampen air flow non-uniformities which contribute to the fiber swirl and otherwise maintain good swirl control over the fibers being drawn through the nozzle.

DETAILED DESCRIPTION

Figure 1:
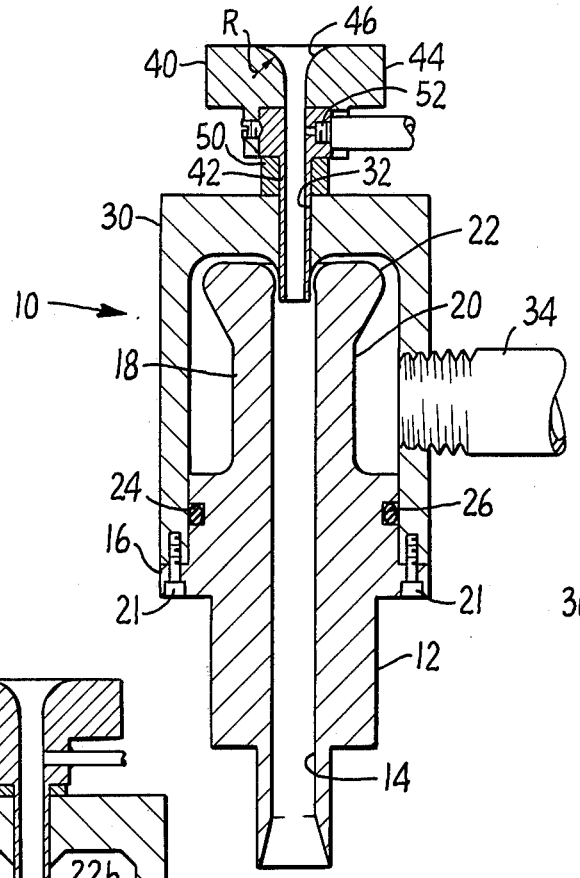
FIG. 1 is an elevational view in section of a preferred form of filament draw nozzle constructed in accordance with the teachings of the present invention.

FIG. 1 illustrates a preferred form of filament draw nozzle 10 constructed in accordance with the teachings of the present invention. The nozzle receives a plurality of fibers from a fiber source (not shown) and transports them downwardly through a draw pipe 11 (FIG. 4) to a moving wire 13. A foil element 15 of the type disclosed in U.S. patent application Ser. No. 115,308, filed Jan. 25, 1980, may be disposed at the bottom of draw pipe 11 to assist in distribution of the fibers which may be drawn onto wire 13 by a vacuum box (not shown) disposed thereunder.

The nozzle 10 includes a throughbore defining means 12 having a throughbore 14 formed therein and a shoulder 16 extending about the periphery of means 12 at a location spaced from the throughbore. Means 12 additionally comprises an upwardly projecting annular boss 18 having a cylindrical peripheral wall 20 leading to a generally smoothly curved surface 22 extending to throughbore 14. A peripheral channel 24 is formed in means 12 at a location adjacent to shoulder 16, said channel accommodating an O-ring seal 26.

Slip fit over throughbore defining means 12 and seated upon shoulder 16 is a housing 30 defining an aperture 32 at the upper end thereof. When the housing 30 is positioned on shoulder 16 the housing is aligned relative to the throughbore defining means so that throughbore 14 and aperture and 32 are coaxial. Precise coaxial alignment may be accomplished by positioning a mandrel (not shown) in throughbore 14 and aperture 32 and then securing the housing to the throughbore defining means by means of screws 21, for example. O-ring 26 provides an airtight seal between throughbores defining means 12 and housing 30. Together the wall 20 of boss 18 and the inner wall of the housing define therebetween an annular air cavity which is in communication with the interior of a conduit 34 connected to a source (not shown) of pressurized air. The annular air cavity is also in communication with a generally increasingly restricted annular passageway or slit leading from the annular air cavity to throughbore 14. The restricted annular passageway is partially defined by the housing 30 and the generally smoothly curved surface 22 of boss 18.

The nozzle of FIG. 1 additionally comprises fiber feed tube 42 having a smooth cylindrical outer wall and slip fit into aperture 32 with said wall bearing against housing 30. The interior of fiber feed tube 42 has a circular cross section and is in communication with throughbore 14 and concentric therewith. The diameter of the fiber feed tube interior is at least 0.2 inches. Because it is slip fit the tube may be readily removed and cleaned by the operator. It should be noted that the inner wall of housing 30 is smoothly curved toward the feed tube outer wall so that said outer wall defines with surface 22 of boss 18 a continuation of the restricted annular passageway or slit.

Fiber inlet defining means 40 additionally includes a body member 44 connected to the fiber feed tube 42 in any desired fashion as by means of set screws, press fit, etc. Alternatively, of course, the body member 44 and fiber feed tube 42 could be integrally formed. Body member 44 has formed therein a shallow bell mouth surface 46 leading to the interior of the fiber feed tube. The term "shallow" as used herein and as applied to surface 46 shall mean that the bell mouth surface formed in body member 44 has a radius of curvature R not exceeding 150 percent of the inner diameter of fiber feed tube 42. The upper extent of surface 46 is preferably curved to define a radius R lying in the range of from about 1/16 inch to about $\frac{3}{8}$ inch. It will be noted that fiber feed tube 42 is concentrically disposed relative to and within throughbore 14. To control the extent to which the fiber feed tube is disposed within the throughbore, spacer means in a form of a ring 50 is positioned between fiber lnlet defining means 40 and the top of housing 30. The fiber feed tube 42 may be raised or lowered by using different sized rings. This may be accomplished readily and the operator can effectively "tune" the nozzle for efficient operation since this depends to a significant degree on placement of the tube end. It has been found that wear is greatest at the tube ends. Rather than replace a complete tube the worn end may be cut off and the tube lowered by using a smaller spacer ring.

Figure 5:
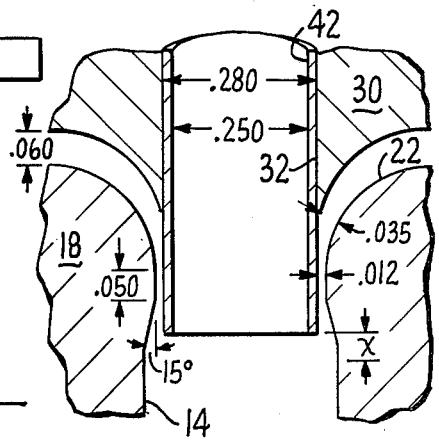
FIG. 5 is an elevational view in section showing operational details of selected elements of the nozzle of FIG. 1.

FIG. 5 illustrates in detail the cooperative relationship existing between fiber feed tube 42, housing 30 and boss 18 at the location whereat the tube projects from the bottom of aperture 32. The annular passageway or slit defined by the housing inner wall and surface 22 of boss 18 gradually reduces in thickness from a central location at the top of the boss to the location whereat the housing terminates and the slit is defined by the tube and boss. In the preferred embodiment of this invention the slit thickness at its central location at the top of the boss is preferably less than 30% of the width of the annular air cavity. In FIG. 5 details of a nozzle actually fabricated are provided wherein such midpoint slit thickness is 0.060 inches. The width of the annular air cavity of such constructed nozzle was 0.375 inches. At the terminal point of the housing the slit thickness has been reduced by approximately half to 0.035 inches. The slit continues to reduce in thickness due to convergence of boss surface 22 and the outer wall of tube 42 until a point is reached whereat curvature of the surface 22 terminates and the boss outer surface has a constant diameter for a distance of 0.050 inches. For this distance the slit defines a throat having a constant thickness of 0.012 inches or approximately 5% of the fiber tube inner diameter of 0.250 inches. The length over which the constant slit thickness extends is preferably in the order of 3 to 4 times minimum slit thickness. The boss wall then forms a divergent at an angle in the order of 15° vertical until the diameter of throughbore 14 is matched.

The annular passageway or slit throat and the diverging passageway to which it leads constitute the elements of a supersonic nozzle and sonic flow at the throat and supersonic flow at the exit of the divergent is established by providing sufficiently high air supply pressures upstream therefrom. Exit Mach numbers (ratio of exit velocity to the velocity of sound) are defined by the ratio of areas of the divergent and the area of the throat. The area of the divergent can be changed by changing the length of divergent, i.e., by the positioning of the lower end of the fiber inlet tube relative to the divergent within a range X. A good working range exists if the area ratios are in the range of 1.7 to 3.2 with a corresponding theoretical exit Mach number range of about 2 to 2.7.

These particular design features also provide an operational safety feature. When the fiber inlet tube is pulled out there is no air blow back which could hurt the operator. The air pressure in the annular passageway drops upon tube removal since the communication to the throughbore 14 occurs through a much longer exit slit (in the order of three times) and the nozzle operates as an internal Coanda nozzle directing the air flow in a downward direction.

In operation, pressurized air is introduced through conduit 34 into the annular air cavity of the nozzle. The pressurized air then flows through the generally increasingly restricted annular passageway and is directed downwardly through throughbore 14. It will be appreciated that flow of the pressurized air will be accelerated as it progresses through the restricted annular passageway along generally smoothly curved surface 22 of boss 18. This will result in a dampening of flow nonuniformities which cause undesired swirl. In the event a swirl controller of the type disclosed in Reba U.S. Pat. No. 3,754,694, issued Aug. 28, 1973, is employed in association with the filament draw nozzle of this invention, swirl control is enhanced due to the high velocity of pressurized air passing through the restricted passageway. It will be appreciated that downward flow of pressurized air in throughbore 14 will create a vacuum in the interior of fiber feed tube 42. Because of the rapidly converging shallow bell mouth surface a high vacuum is located at the fiber inlet opening. Consequently, rapid nozzle threading is facilitated and nozzle plugging is minimized. In fact, it has been found that a nozzle of the type illustrated in FIG. 1 is virtually self cleaning in that broken filaments disposed about the nozzle tops will be continuously vacuumed off by the high inlet suction. The relatively large diameter of tube 42 permits even clumps or polymer beads up to a quarter of an inch to readily pass therethrough.

Figure 4:
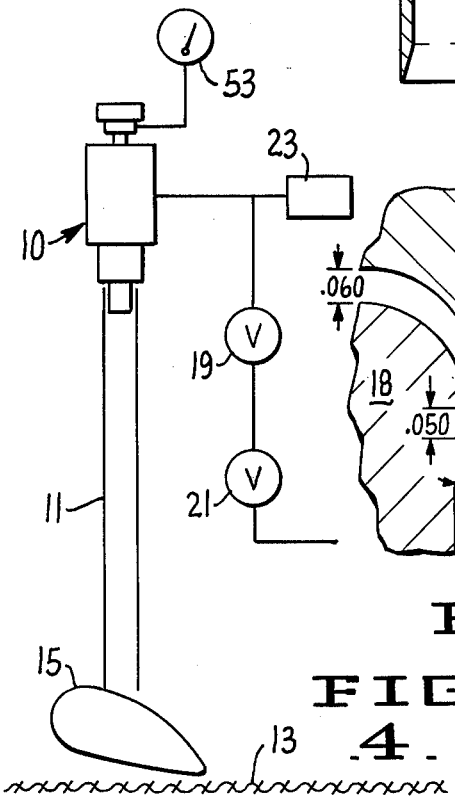
FIG. 4 is a schematic illustration of a filament draw nozzle and associated structure.

Fiber inlet defining means 40 can be easily instrumented with a static pressure probe 52, in communication with the fiber feed tube below the bell mouth surface 46, thus providing continuous monitoring of nozzle performance and loading. FIG. 4 schematically illustrates a vacuum gauge 53 associated with such a probe. It will be appreciated that nozzle 10 is only one of many disposed in an array over wire 13 and that the nozzles have different performance characteristics. To make up for any such differences different air pressures may be applied to the nozzles to ensure that the vacuums in the fiber inlet tubes are essentially the same as shown by vacuum gauges attached to each nozzle. This is first done without filaments passing through the nozzles, air pressure adjustment being made by a control valve 19 between the nozzle and a source of compressed air. After the nozzles have been individually adjusted to equalize the vacuums in the fiber inlet tubes thereof the operator introduces identical numbers of filaments into the nozzles. Any changes in vacuum thereafter will indicate changes in fiber loading in the nozzles caused for example by the accidential jumping of fiber strands between nozzles due to their close proximity to one another. The operator can easily detect this by comparing gauge readings and take appropriate steps to correct the problem. A separate quick shut off valve 21 is also preferably employed in line 34 as is a swirl control handle 23 if a swirl control mechanism of the type shown, for example, in Reba U.S. Pat. No. 3,754,694, issued Aug. 28, 1973, is employed in association with nozzle 10.

As indicated above, the fiber inlet defining means may be readily removed by the operator for cleaning or other purposes. It has been found that removal can take place even while pressurized air is being introduced to the nozzle without upward blow back of the air occurring. This is due to the fact that surface 22 functions as a Coanda surface directing pressurized air downwardly into throughbore 14 due to the Coanda effect, as stated above.

Figure 2:
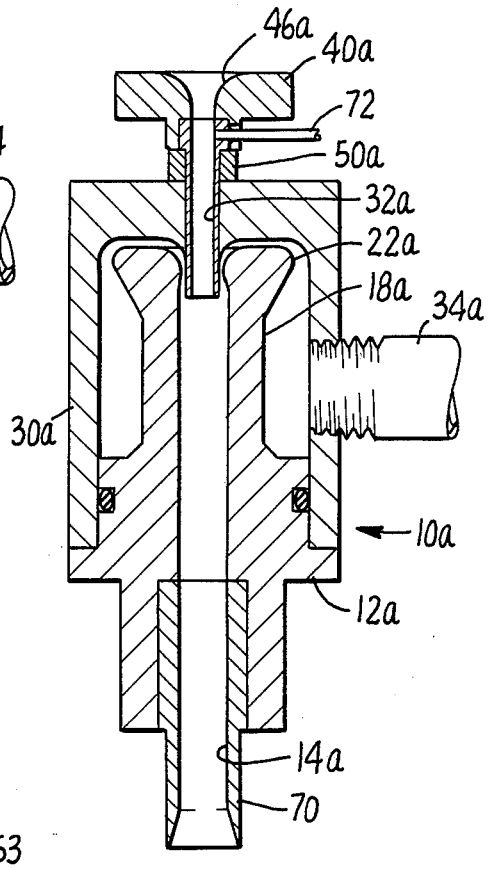
FIG. 2 is a view similar to that of FIG. 1 but illustrating an alternative embodiment.

Referring now to FIG. 2, an alternative embodiment of filament draw nozzle constructed in accordance with the teachings of the present invention is illustrated. The FIG. 2 embodiment is quite similar to that illustrated in FIG. 1 and corresponding parts carry corresponding part numbers with the addition of modifier reference letter "a". In the FIG. 2 embodiment a separate tail pipe 70 is secured in any desired manner to the rest of throughbore defining means 12*a* as by being press fit thereto, for example, A separate tail pipe can cause excessive noise and interference with air and fiber flow unless perfectly matched to the throughbore defining means. For that reason a one piece throughbore defining means such as that shown in FIG. 1 is preferred. In addition, fiber inlet defining means 40*a* has a somewhat different configuration that fiber inlet defining means 40 in FIG. 1 and has incorporated therein a monitoring probe 72 soldered or otherwise fixedly secured to body member 44*a*. Further, the precise geometry of the nozzle annular air cavity and restricted annular passageway differs somewhat from that of the FIG. 1 embodiment.

Figure 3:
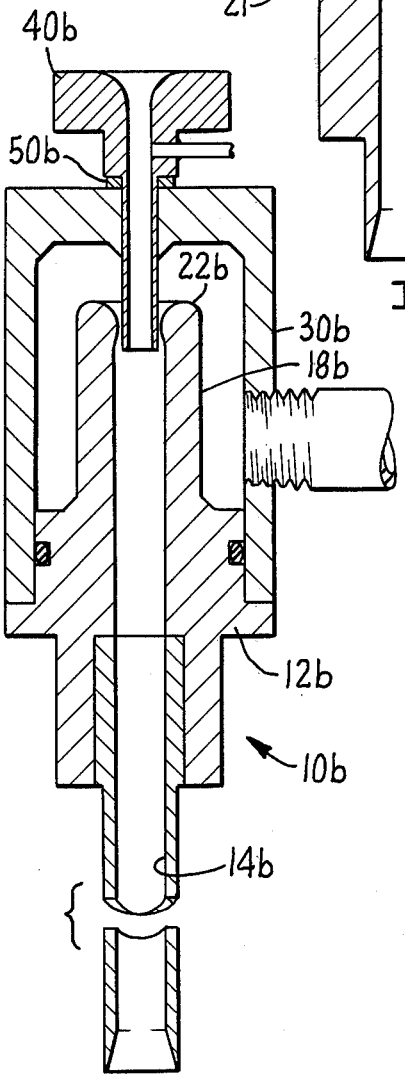
FIG. 3 is a view similar to that FIG. 1 but illustrating yet another alternative embodiment.

FIG. 3 shows yet another embodiment of the filament draw nozzle of the present invention, the primary difference residing in te elimination of a restricted passageway defined by generally smoothly curved surface 22*b* of boss 18*b*. In other words, the width of the passageway leading from the annular air cavity of the nozzle in FIG. 3 approximates that of the annular air cavity. This arrangement has not been found to be quite as satisfactory as the arrangements illustrated in FIGS. 1 and 2.

It may be seen from the above that nozzles constructed in accordance with the teachings of the present invention have several advantages over prior art nozzles. The nozzles of this invention may operate even at very low supply pressures (in the range of two atmospheres) and stil establish supersonic flow expansion even at high fiber loading. These nozzles, however, can also work at high pressures, e.g. twenty atmospheres. Operational pressure is chosen depending upon the denier of the fibers. Normal operation is at about ten atmospheres. In addition, the nozzles are easy to load, clean, repair and monitor and have low noise characteristics.

I claim:

1. A filament draw nozzle comprising, in combination:

means defining a throughbore, and including an upwardly projecting annular boss, said boss having a cylindrical peripheral wall leading to a generally smoothly curved surface extending to said throughbore;

a housing defining an aperture and including an inner wall curving downwardly and leading to said aperture, said housing being positioned in engagement with said throughbore defining means with said housing aligned relative to said throughbore defining means to define a pressurizable annular air cavity therewith, said housing inner wall and said generally smoothly curved surface defining an annular downwardly directed slit providing communication between said air cavity and said throughbore whereby pressurized air in said cavity passes through said slit to said throughbore and downwardly along said generally smoothly curved surface; and fiber inlet defining means including a cylindrical fiber feed tube having an outer wall selectively removably positionable in said housing aperture with said outer wall bearing against said housing, said throughbore and said housing aperture being disposed in alignment whereby said fiber feed tube when positioned in said aperture is concentrically disposed relative to and within said throughbore and defines with said generally smoothly curved surface a supersonic nozzle, said slit and said generally smoothly curved surface defining a Coanda nozzle directing and maintaining air flow in a downward direction through said throughbore and said housing aperture when said fiber feed tube is removed from said housing aperture.

2. The filament draw nozzle of claim 1 wherein said fiber inlet defining means additionally includes a body member connected to said fiber feed tube, said body member having a shallow bell mouth surface leading to the interior of said fiber feed tube.

3. The filament draw nozzle of claim 1 wherein said housing is slip fit over said throughbore defining means and said fiber inlet defining means is slip fit in said housing aperture.

4. The filament draw nozzle of claim 1 wherein said throughbore defining means includes a shoulder extending about the outer periphery thereof with said housing positioned on said shoulder in abutting engagement therewith, said nozzle further comprising an O-ring seal positioned in a groove formed in said housing and providing an air tight seal between said housing and said throughbore defining means at a location adjacent to said shoulder.

5. The filament draw nozzle of claim 1 wherein said fiber feed tube interior has a circular cross section and is in communication with said throughbore and concentric therewith, the diameter of said interior being at least 0.2 inches.

6. The filament draw nozzle of claim 1 wherein the width of said annular downwardly direct slit at the top of the boss is less than about 30 percent of the width of said annular air cavity.

7. The filament draw nozzle of claim 1 wherein said housing inner wall curves toward said fiber feed tube outer wall when said fiber feed tube is positioned in said housing aperture whereby said fiber feed tube defines with said generally smoothly curved surface a continuation of said slit.

8. The filament draw nozzle of claim 7 wherein said annular boss further includes a surface having constant diameter over a predetermined distance, said constant diameter surface defining with said fiber feed tube an annular passageway of a fixed width extending said distance and in communication with said slit.

9. The filament draw nozzle of claim 8 wherein said annular boss forms an area of divergence with said fiber feed tube outer wall communicating with said annular fixed width pasageway.

10. The filament draw nozzle of claim 1 additionally comprising spacer means removably positioned between the fiber inlet defining means and the housing for maintaining the lower end of the fiber feed tube at a predetermined location within said throughbore.

11. The filament draw nozzle of claim 10 wherein said spacer means comprises a ring positioned about the fiber feed tube above said housing.

* * * * *